US008176831B2

(12) United States Patent
Kucherov et al.

(10) Patent No.: US 8,176,831 B2
(45) Date of Patent: May 15, 2012

(54) ARMOR PLATE

(75) Inventors: Yan R. Kucherov, Alexandria, VA (US); Graham K. Hubler, HIghland, MD (US)

(73) Assignees: Nova Research, Inc., Alexandria, VA (US); The United States of America, as represented by the Secretary of the Navy, Washington, DC (US)

( * ) Notice: Subject to any disclaimer, the term of this patent is extended or adjusted under 35 U.S.C. 154(b) by 93 days.

(21) Appl. No.: 12/291,063

(22) Filed: Apr. 10, 2009

(65) Prior Publication Data

US 2010/0257997 A1 Oct. 14, 2010

(51) Int. Cl.
*F41H 5/08* (2006.01)
*F41H 5/04* (2006.01)

(52) U.S. Cl. ..... 89/36.05; 89/36.02; 89/904; 89/922

(58) Field of Classification Search ..... 89/36.01, 89/36.02, 36.04, 36.05, 36.07, 36.11, 36.12, 89/36.13, 36.15, 36.16; 428/911
See application file for complete search history.

(56) References Cited

U.S. PATENT DOCUMENTS

| | | | | |
|---|---|---|---|---|
| 2,562,467 | A | | 7/1951 | Kinnear, Jr. |
| 3,577,836 | A | | 5/1971 | Tamura |
| 3,633,520 | A | | 1/1972 | Stiglich, Jr. |
| 3,634,177 | A | | 1/1972 | Glaser |
| 3,666,614 | A | | 5/1972 | Snedeker et al. |
| 3,829,899 | A | | 8/1974 | Davis |
| 3,863,541 | A | | 2/1975 | Cline et al. |
| 4,201,828 | A | | 5/1980 | Triebel et al. |
| 4,663,228 | A | | 5/1987 | Bolton et al. |
| 4,836,084 | A | * | 6/1989 | Vogelesang et al. ..... 89/36.02 |
| 5,059,467 | A | | 10/1991 | Berkovitz |
| 5,060,553 | A | | 10/1991 | Jones |
| 5,087,516 | A | | 2/1992 | Groves |
| 5,110,661 | A | | 5/1992 | Groves |
| H1061 | H | | 6/1992 | Rozner et al. |
| 5,179,244 | A | | 1/1993 | Zufle |
| 5,180,880 | A | | 1/1993 | Zufle |
| 5,326,606 | A | * | 7/1994 | Labock ..... 428/49 |
| 5,349,893 | A | | 9/1994 | Dunn |
| 5,364,679 | A | | 11/1994 | Groves |
| H1519 | H | | 3/1996 | Semple |
| H1567 | H | | 8/1996 | Parsons et al. |
| 5,622,776 | A | | 4/1997 | Esu |

(Continued)

FOREIGN PATENT DOCUMENTS

DE 10 2007 025 894 A1 12/2008

(Continued)

OTHER PUBLICATIONS

International Search Report and Written Opinion for PCT/US2010/028908 issued Jul. 22, 2010.

(Continued)

*Primary Examiner* — Bret Hayes
(74) *Attorney, Agent, or Firm* — Workman Nydegger

(57) ABSTRACT

An armor plate transforms projectile energy into solid-state lattice waves and facilitates absorption of these waves at different wavelengths. For high frequency lattice waves, dopants are used for absorbing the lattice waves and converting them to thermal energy. Heavy dopants and layered materials can also be use for reflecting lattice waves to facilitate attenuation through absorption. A spreading layer can also be used for dispersing non-absorbed lattice waves.

35 Claims, 7 Drawing Sheets

U.S. PATENT DOCUMENTS

| | | | | |
|---|---|---|---|---|
| 5,692,384 | A | 12/1997 | Layton | |
| 5,900,097 | A * | 5/1999 | Brown | 156/264 |
| 6,112,635 | A * | 9/2000 | Cohen | 89/36.02 |
| 6,189,327 | B1 | 2/2001 | Strauss et al. | |
| 6,203,908 | B1 * | 3/2001 | Cohen | 428/397 |
| 6,253,655 | B1 * | 7/2001 | Lyons et al. | 89/36.02 |
| 6,418,832 | B1 | 7/2002 | Colvin | |
| 6,537,654 | B1 * | 3/2003 | Gruber et al. | 428/293.4 |
| 6,635,357 | B2 * | 10/2003 | Moxson et al. | 428/548 |
| 6,698,331 | B1 | 3/2004 | Yu et al. | |
| 6,912,944 | B2 | 7/2005 | Lucuta et al. | |
| 7,104,177 | B1 | 9/2006 | Aghajanian et al. | |
| 7,332,221 | B2 | 2/2008 | Aghajanian et al. | |
| 7,459,105 | B2 * | 12/2008 | Chandran | 252/520.22 |
| 7,584,689 | B2 | 9/2009 | Jones et al. | |
| 7,793,580 | B2 | 9/2010 | Jones et al. | |
| 2004/0161989 | A1 | 8/2004 | Dennis et al. | |
| 2005/0172792 | A1 * | 8/2005 | Wolf et al. | 89/36.02 |
| 2006/0060077 | A1 | 3/2006 | Lucuta et al. | |
| 2006/0253950 | A1 | 11/2006 | Kerr | |
| 2007/0068375 | A1 | 3/2007 | Jones et al. | |
| 2007/0068376 | A1 | 3/2007 | Jones et al. | |
| 2007/0283801 | A1 | 12/2007 | Gallo | |
| 2008/0011153 | A1 | 1/2008 | MacDonald | |
| 2008/0092729 | A1 | 4/2008 | Cook | |
| 2008/0104735 | A1 | 5/2008 | Howland | |
| 2008/0187721 | A1 | 8/2008 | Engl | |
| 2008/0264243 | A1 | 10/2008 | Lucuta et al. | |
| 2008/0318080 | A1 * | 12/2008 | Branagan | 428/635 |
| 2009/0108507 | A1 * | 4/2009 | Messing et al. | 264/605 |
| 2009/0136702 | A1 | 5/2009 | Gu | |
| 2009/0217813 | A1 | 9/2009 | Carberry et al. | |
| 2009/0308239 | A1 | 12/2009 | Jones et al. | |
| 2010/0288117 | A1 | 11/2010 | Jones et al. | |

FOREIGN PATENT DOCUMENTS

| | | | |
|---|---|---|---|
| EP | 0 731 332 | | 9/1996 |
| EP | 1 898 174 | | 3/2008 |
| RU | 2359832 | C1 | 6/2009 |
| WO | WO2006/135832 | A2 | 12/2006 |
| WO | WO2008/130457 | A2 | 10/2008 |
| WO | WO2008/150355 | A1 | 12/2008 |
| WO | WO2009/042877 | A2 | 4/2009 |
| WO | WO2009/096930 | A1 | 8/2009 |

OTHER PUBLICATIONS

Koizumui et al., *Lattice Wave Emission from a Moving Disloction*, Phys. Rev. B. 65, 214104, 2002.

Nadgornyi, E., *Dislocation Dynamics and Mechanical Properties of Crystals*, Progress in Material Science, V. 31, Pergamon Press, 1988, pp. iv-180.

Nadgornyi, E., *Dislocation Dynamics and Mechanical Properties of Crystals*, Progress in Material Science, V. 31, Pergamon Press, 1988, pp. 181-360.

Nadgornyi, E., *Dislocation Dynamics and Mechanical Properties of Crystals*, Progress in Materials Science, V. 31, Pergamon Press, 1988, pp. 361-536.

V.A. Al'shitz and V.L. Indenbom, *Dynamic Dragging of Dislocations*, Sov. Physics-Usp., V. 18, No. 1, pp. 1-20, 1975.

A.A. Maradudin et al, *Lattice Dynamics*, Benjamin, NY, 1969, pp. 332-380.

Parimal J. Patel et al., *Transparent Armor*, AMPTIAC Newsletter, Fall 2000, vol. 4, No. 3, pp. 1-5.

C.G. Fountzoulas et al., *A computational Study of Laminate Transparent Armor Impacted by FSP*, Army Research Laboratory, Jun. 2009, 14 pages.

Parimal J. Patel et al., *Improved Low-Cost Multi-Hit Transparent Armor*, Nov. 1, 2006.

D. Heiman et al., *Brillouin Scattering Measurements on Optical Glasses*, Physical Review B, vol. 19, No. 12, Jun. 15, 1979, pp. 6583-6592.

International Search Report and Written Opinion for PCT/US2011/024579 issued Nov. 25, 2011.

Office Action issued Aug. 16, 2011 in U.S. Appl. No. 12/708,991, filed Feb. 19, 2010.

* cited by examiner

ARMOR PLATE

GOVERNMENT LICENSE RIGHTS

The U.S. Government has a paid-up license in this invention and the right in limited circumstances to require the patent owner to license others on reasonable terms as provided for by the terms of contract No. N00173-07-C-2055 awarded by U.S. Naval Research Laboratory.

CROSS-REFERENCE TO RELATED APPLICATIONS

Not applicable.

BACKGROUND OF THE INVENTION

1. The Field of the Invention

This invention relates to armor in general and, more specifically, to armor plates, such as can be used in body armor, that have increased efficiency in the attenuation of applied energy produced by an impacting projectile.

2. The Relevant Technology

Current body armor systems typically comprise soft armor that is formed from layers of woven high strength fibers such as aramide (Kevlar®) fibers. This soft armor can reliably stop bullets and small fragments having a velocity up to 500-600 m/s. To provide protection against faster projectiles, soft armor is augmented with hard armor inserts, or Supplementary Armor Plate Inserts (SAPI). SAPIs are typically made of titanium alloys or a ceramic and considerably increase the weight of body armor, thereby decreasing the mobility and stamina of the wearer. Armor plating can also be used for reinforcing other structures such as vehicles, buildings or the like. In each case, the armor plating is typically designed so as to prevent a projectile from passing therethrough.

What is needed in the art are armor plates that have an increased efficiency in the attenuation of applied energy produced by an impacting projectile. When used as a SAPI, such armor plates would provide increased safety to the wearer of the body armor and/or would permit the use of lighter weight SAPIs so as to thereby increase the mobility and stamina of the wearer while providing the same level of protection.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
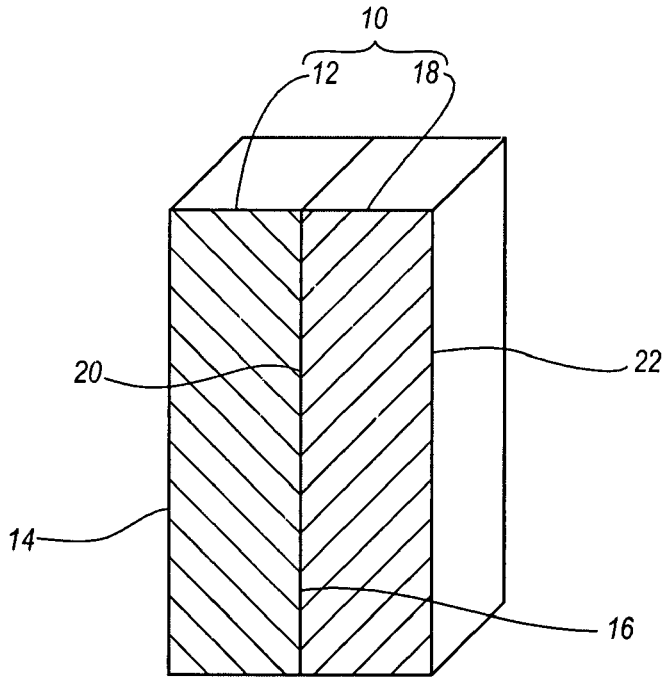
FIG. 1 is a perspective, cross sectional side view of an armor plate incorporating features of the present invention and having a transformation layer secured to an absorption layer, the absorption layer having dopants.

The present invention relates to armor having improved efficiency in the attenuation of energy applied from an impacting projectile. More specifically, in one embodiment the inventive armor is configured to absorb and/or spread lattice waves that are produced within the armor as a result of a striking projectile. The inventive armor will most commonly be in the form of body armor. For example, inventive armor plates can function as Supplementary Armor Plate Inserts (SAPI) in conventional soft armor shells. Alternatively, however, the inventive armor or concepts thereof can also be used for other applications such as armor for shields, turrets, vehicles, buildings, or other objects. By absorbing the lattice waves produced within the armor, the energy carried by the lattice waves is not transferred onto the wearer of the body armor or onto the structure on which the armor is applied. By spreading the lattice waves, the localized blunt trauma commonly produced by a projectile can be decreased by spreading the localized force over a larger area.

The impact of a projectile onto an armor plate can produce multiple effects. If equivalent hydrodynamic pressure exceeds the material strength of the armor plate there is a Bernoulli-type material flow. The initial impact of the projectile also produces compression waves with relatively low equivalent frequency. Other effects on the armor plate include cracking, deformation, and the like. Most of these effects are associated with the movement of atomic dislocations within the matrix of the armor plate. In turn, movement of the dislocations generates lattice waves within the armor plate. The efficiency of transforming energy spent on movement on movement of dislocations into lattice waves can be extremely high, exceeding 80%.

Upon impact by a projectile, the material of an armor plate deforms approximately at a rate corresponding to the projectile velocity V, which is typically around 1 km/s for rifle bullets. The velocity of lattice waves in solids is close to the speed of sound or typically about 5-15 km/s. This difference in speed between deformation of the armor plate and travel of the lattice waves allows some time to absorb energy before the projectile arrives to a given spot and/or allows for strengthening the material in front of the projectile by compressing the material. As discussed below in more detail, local compression of an armor plate by reflected elastic waves slows crack formation and propagation.

A dislocation moving at velocity V in a solid can generate lattice waves with a fundamental frequency $\omega_0=2\pi$ V/a, where a is the lattice parameter, approximately 0.4 nm for most solids. At V=1 km/s, $\omega_0$ is close to $1.5\times10^{13}$ Hz. The corresponding wavelength for a lattice wave in iron is approximately the same as the distance between atoms in the lattice. A projectile moving through the armor drags dislocations adjacent to the projectile at approximately the same velocity as the projectile itself. At a few atomic spacings from the dislocation, lattice waves organize into elastic waves with a frequency corresponding to minimum attenuation. It is these elastic lattice waves that the present invention is directed to absorbing and/or spreading. In the transition zone between the dislocation and the organized elastic waves, lattice waves are mostly anharmonic phonons where there is already significant transformation of the energy of the lattice waves into heat.

Movement of a dislocation within a lattice structure creates lattice waves having a frequency spread of the order of $k_B T$, where $k_B$ is Boltzmann constant and T is the absolute temperature. The corresponding frequency spread $\Delta\omega$ equals $k_B T/\hbar$, where $\hbar$ is Plank constant. In one example the frequency spread of the lattice waves is approximately $3\times10^{12}$ Hz at room temperature. Further away from the projectile there is no dislocation movement. This implies that another type of transition zone exists, where dislocations are moving, but slower than the ones adjacent to the projectile. This transition zone will produce lattice waves with lower frequency and lower intensity.

When using an armor plate for body armor, the armor plate not only must stop the projectile but also minimize blunt trauma effect, which can be extremely dangerous. To this end, one way to minimize the momentum transfer to the body is to convert some of the projectile kinetic energy into heat. The part of energy converted into heat does not carry oriented momentum and thus will be subtracted from the projectile kinetic energy. The residual momentum p will be carried by the armor plate, $p=\sqrt{2m(E_k-H)}$. Here $E_k$ is the projectile kinetic energy, m is the mass (in the end it is the sum of plate and projectile masses, assuming that the projectile is stopped in the plate), and H is the part of the energy converted into heat. Lattice wave energy can most efficiently be converted into heat when the period of the lattice wave is smaller than the thickness of the plate, i.e., when frequency of the lattice wave is higher than $\sim10^6$ Hz. Lattice waves at a frequency lower than $\sim10^6$ Hz can typically not be converted into heat fast enough to decrease projectile kinetic energy applied to the wearer of the armor.

After high velocity impact, the projectile continues to move inside the armor plate with gradually diminishing velocity. Close to the impact spot, the velocity of the projectile is close to the velocity before the impact. At this location, the lattice wave frequency is in the tens of terahertz range with wavelengths comparable to the atomic spacing for the material of the armor plate. For alumina wherein the speed of sound travels at a speed of approximately 10 km/s, a lattice wave frequency of $10^{13}$ Hz corresponds to a lattice wave wavelength of 1 nm, a frequency of $10^9$ Hz corresponds to a wavelength of 10 microns and a frequency of $10^7$ Hz corresponds to a wavelength of 1 mm. The frequency of the lattice waves is highest closer the region where the projectile strikes the armor plate. As the projectile slows within the armor plate, the resulting lattice waves are produced with a lower frequency. Furthermore, the high frequency lattice waves decay into lower frequency waves as the lattice waves move through the armor plate.

In view of the foregoing, depicted in FIG. 1 is a perspective, cross sectional side view of one embodiment of an armor plate 10 incorporating features of the present invention. Armor plate 10 comprises a transformation layer 12 having a front face 14 and an opposing back face 16. Armor plate 10 also comprises an absorption layer 18 having a front face 20 and an opposing back face 22. Front face 20 of absorption layer 18 is secured to back face 16 of transformation layer 12 so that lattice waves generated within transformation layer 12 can propagate into absorption layer 18.

In general, as discussed below in greater detail, transformation layer 12 is configured to optimize the formation of lattice waves therein when a projectile strikes transformation layer 12 from front face 14. In contrast, absorption layer 18 is configured to absorb the lattice waves propagated from transformation layer 12 so that the energy of the lattice waves is not fully transferred to the person or structure on which armor plate 10 is positioned. In general, the absorption can occur by doping absorption layer 18 with dopants that absorb that lattice waves and convert them to thermal energy. Alternatively, absorption layer 18 can be formed from a multi-layered material that repeatedly reflects the lattice waves. Reflecting the lattice waves increases the distance that the lattice waves travel within absorption layer 18 which in turn increases the attenuation of the lattice waves. The dopants can also reflect lower frequency lattice waves which increases their travel path and attenuation.

As a result of the absorption of the lattice waves within absorption layer 18, there is a reduction in the kinetic energy that is transferred from the projectile, through armor plate 10, and onto the person or structure on which armor plate 10 is positioned. The properties for transformation layer 12 and absorption layer 18 are also based on the need for ensuring that armor plate 10 has sufficient strength properties so that the projectile does not pass through armor plate 10 or at least through armor plate 10 and any other armor that may be associated therewith. Furthermore, where armor plate 10 is used as a SAPI or otherwise as part of body armor, armor plate 10 should be sufficiently thin and light so that armor plate 10 does not unduly burden the wearer of armor plate 10.

As now discussed in greater detail, it is necessary that transformation layer 12 be comprised of a material that deforms as the projectile is impacting therewith since deformation of transformation layer 12 is what causes movement of the dislocations which in turn produces the lattice waves. However, transformation layer 12 needs to have sufficient strength to assist in stopping a projectile having predefined properties from passing through armor plate 10 and have desired weight properties. To maximize the effective properties of the transformation layer 12, it is also desirable that transformation layer 12 be comprised of a material that will remain in continuous, tight engagement with the projectile as the projectile impacts and passes into transformation layer 12. In one embodiment, transformation layer 12 is comprised of a material having a tensile strength in a range between about 50 MPa to about 500 MPa. Depending on the intended use and what other layers are used with transformation layer 12, materials having higher or lower tensile strength can also be used.

Transformation layer 12 typically has a deformation before failure of at least 20% and more commonly at least 30%. Common ranges of deformation before failure are between about 20% to about 150% with about 30% to about 150%, or about 40% to about 150% also being common. In one embodiment, transformation layer 12 can be a metal such as titanium, steel, aluminum or an alloy thereof; a polymer such as a polycarbonate (one example being LEXAN) or a high molecular weight polyethylene; and other materials that have the properties as outlined above and combinations thereof.

One of the better materials for transformation layer 12 is pure titanium, which has reasonable strength and allows up to 70% elongation before breaking. Titanium is also very reactive, thereby helping to ensure continuous engagement between the projectile and transformation layer 12. Titanium alloys developed for armor applications are 2-3 times stronger than pure titanium, but only allow about 10% elongation, making them less desirable for transformation layer 12. Some steel alloys, like 316 stainless steel, allow approximately 30% elongation at significant strength. Although aluminum allows approximately 50% elongation, its strength is nearly ten times less than titanium. To achieve desired mechanical properties, transformation layer 12 can be free or at least substantially free of dopants. Adding dopants can make the material more brittle which decreases the ability to form lattice waves. Alternatively, dopants can be added to transformation layer 12 to achieve the absorption and other properties as discussed below with regard to the absorption layer.

When transformation layer 12 is being used as a SAPI or other body armor, transformation layer 12 has a thickness, which can be a minimum or maximum thickness, extending between front face 14 and back face 16 in a range between about 1 mm to about 25 mm with about 1 mm to about 15 mm, about 1 mm to about 10 mm and about 1 mm to about 5 mm being more common. Larger thicknesses such as in a range between about 1 cm to about 5 cm or larger can also be used in some applications. Such larger thicknesses, however, are less common in body armor due to the associated weight. It is appreciated that faces 14 and 16 need not be smooth or planar but can be contoured in any desired configuration. Furthermore, transformation layer 12 need not have a uniform thickness but can vary based on intended use.

As mentioned above in one embodiment, absorption layer 18 can be specifically designed to facilitate conversion of lattice waves into thermal energy within absorption layer 18, thereby reducing the kinetic energy that is transferred from the projectile through armor plate 10. Ideally, the best natural absorption could be achieved if the frequency of the lattice waves corresponded to the first harmonics of the armor plate material phonon spectrum. In reality, however, the frequency of the lattice waves is constantly changing and there is only a narrow absorption resonance. What complicates things further is that a highly symmetric lattice does not absorb energy very well.

The addition of isotopic dopants into a solid-state lattice breaks lattice symmetry and creates local phonon absorption centers that absorb lattice waves. For dopants heavier than lattice atoms, i.e., heavy dopants, the phonon absorption centers have a sharp resonance that efficiently absorbs high frequency lattice waves over a narrow frequency range. For dopants lighter than lattice atoms, i.e., light dopants, the phonon absorption centers have a less pronounced resonance that absorb lattice waves over a wider frequency range but at a lower efficiency. The heavy and lighter dopants are typically efficient for absorbing lattice waves having a frequency over about $10^{12}$ Hz. The added dopants, especially heavy ones, also form local lattice deformations that cause refraction of the lattice waves. Continued refraction of the lattice waves improves absorption as discussed further below and creates broadband interaction possibilities.

In view of the foregoing, in one embodiment absorption layer 18 is comprised of a base material having one or more dopants dispersed therein. The base material typically comprises a metal or ceramic. Typical metals used as the base material comprise titanium, steel, aluminum or an alloy thereof Typical ceramics used as the base material comprise $Al_2O_3$, $B_4C$, $TiB_2$, SiC or $ZrO_2$. The ceramics can also include a variety of ceramic glasses like silicates, cordierites and the like. One example of a cordierite that can be used is $Mg_2Al_4Si_5O_{18}$. The ceramic $ZrO_2$ stands out as it has relatively heavy atom Zr. Other metals and ceramics can also be used. The one or more dopants typically comprise a heavy dopant and/or a light dopant. The heavy dopants are those where the atoms are heavier than the atoms of the base material. Examples of heavy dopants include Zr, Mo, Dy, Yb, Hf, W, Ta, Th, $TiZrO_4$, and U. Examples of light dopants include Ti, Cr, Mn, Fe, and Co. Dopants can also include molecules of compounds that include one or more of the foregoing dopants. It is appreciated that whether an element or compound is a dopant and whether it is a heavy or light dopant depends on the composition of the base material. Other heavy and light dopants can also be used.

One alternative way to absorb elastic lattice waves is to use isotopic mass difference effect. That is, different isotopes of same substance can be used as the dopant for the base material. For example, zirconium has five stable isotopes with atomic numbers: 90 (51%); 91 (11%); 92 (17%); 94 (17%); 96 (3%). Even on its own zirconium has good absorption of high frequency lattice waves. The addition of titanium, which also has five stable isotopes, 46 (8%); 47 (97%); 48 (74%); 49 (5%); 50 (5%), creates 10 absorption resonances at different frequencies. Titanium and zirconium oxides can be mixed in a broad concentration range and even form $TiZrO_4$ oxide, which is a promising dopant for armor applications. Heavy dopants also provide a side benefit of assisting in the absorption low frequency lattice waves, as will be discussed below in greater detail.

In one embodiment, the dopants are added in an atomic percentage in a range between about 0.5% to about 20% with about 0.5% to about 10%, about 0.5% to about 5%, and about 0.5% to about 2% being more common. Higher percentages can also be used. However, a few atomic percent of dopant atoms is sufficient to break lattice symmetry. Depending on the intended use of armor plate 10, it is appreciated that absorption layer 18 can be doped with one, two, or more heavy dopants and/or one, two or more light dopants. Absorption layer 18 can be doped with the dopants or otherwise be formed with the dopants using any conventional method.

As depicted in FIG. 1, absorption layer 18 has a first side face 20 and an opposing second side face 22 with a thickness extending therebetween. When absorption layer 18 is being used as a SAPI or other body armor, absorption layer 18 typically has a thickness, which can be a minimum or maximum thickness, extending between front face 20 and back face 22 in a range between about 1 mm to about 25 mm with about 1 mm to about 15 mm, about 1 mm to about 10 mm and about 1 mm to about 5 mm being more common. Larger thicknesses such as in a range between about 1 cm to about 5 cm or larger can also be used in other applications. Such larger thicknesses, however, are less common in body armor due to the associated weight. As with transformation layer 12, faces 20 and 22 of absorption layer 18 need not be smooth or planar but can be contoured in any desired configuration. Furthermore, absorption layer 18 need not have a uniform thickness but can vary based on intended use.

First side face 20 of absorption layer 18 is coupled with second side face 16 of transformation layer 12 so that lattice waves produced within transformation layer 12 can propagate into absorption layer 18. Absorption layer 18 can be secured to transformation layer 12 by adhesive, welding, press fit connection, clamping, fasteners or the like. Absorption layer 18 can also be formed on transformation layer 12 such as by deposition or other method. In one embodiment absorption layer 18 is secured to transformation layer 12 by an adhesive such as polybuteral, epoxy, or other conventional resins or adhesives. It is appreciated that the type of connection between absorption layer 18 and transformation layer 12 is typically of lower importance because when the projectile strikes transformation layer 12, the impact drives transformation layer 12 into absorption layer 18 so that there is sufficient engagement therebetween so that the lattice waves can propagate therebetween. To that end, in some embodiments transformation layer 12 need not be directly connected to absorption layer 18 but only disposed adjacent thereto and in alignment therewith so that transformation layer 12 drives into absorption layer 18 when struck by a projectile. However, connecting transformation layer 12 to absorption layer 18 can help ensure that the layers are not unintentionally offset. The connection can also provide other mechanical benefits.

As discussed above, the heavy dopants are added in absorption layer with the intent of, absorbing high frequency lattice waves over generally narrow frequency ranges and converting the lattice waves into thermal energy. However, heavy dopants can also be used to reflect lattice waves at low frequencies which also assists in the absorption of those lattice waves.

More specifically, as the projectile slows down within transformation layer 12, the frequency of the generated lattice waves decreases. Furthermore, the initially generated high frequency lattice waves scatter as they travel through the armor plate and thereby decompose into lower frequency waves. The attenuation coefficient for lattice waves is a strong function of frequency and is greater for higher frequency lattice waves. To a lesser extent, the attenuation coefficient for lattice waves is also a function of the distance that the lattice waves travel through the matrix. That is, the lattice waves attenuate as they travel through the matrix of the armor plate even without being absorbed by the dopants. This also occurs by the matrix material absorbing the lattice waves and converting them to thermal energy. Such attenuation, however, quickly decreases as the frequency decreases.

Further away from the impact point of the projectile, the lattice wave frequency decreases roughly as distance in the second power. At wave frequency below roughly $10^8$ Hz, the attenuation coefficients are small enough so that the lattice waves can travel the distance of the thickness of the armor plates without significant attenuation. However, if wave reflections are formed within absorption layer 16, the effective wave path of the lattice waves can be increased. By increasing the effective wave path for the lattice waves, the lower frequency lattice waves can be significantly attenuated by the time they reach the backside of the armor plate, thereby reducing the kinetic energy transferred through armor plate. That is, although the attenuation coefficient for low frequency lattice waves is relatively low, the attenuation of the low frequency lattice waves can be significant if the effective path of the lattice waves is significantly increased. For lattice waves having a frequency below $10^6$ Hz the attenuation coefficient is typically so low that no significant attenuation occurs even by increasing the effective wave path within the armor plate.

The introduction of heavy dopants into absorption layer 18 creates local lattice distortion. The lattice distortions result in the refraction of lattice waves propagating through absorption layer 18. Multiple refractions increase the equivalent length that the lattice waves travel and thereby increase attenuation. The list of heavy dopants that can be used for forming local lattice distortions is the same as for high frequency attenuation as discussed above. The heavy dopants can be added in the same percentages as discussed above. However, with regard to refracting low frequency lattice waves, the atomic percentages of heavy dopants in the range of 0.5% to about 6% or about 0.5% to about 3% would be more common. At higher concentrations local deformations can overlap, thereby reducing refraction. The dopants thus function to absorb high frequency lattice waves and to refract both the non-absorbed portion of the high frequency lattice waves and to refract the lower frequency lattice waves.

Figure 2:
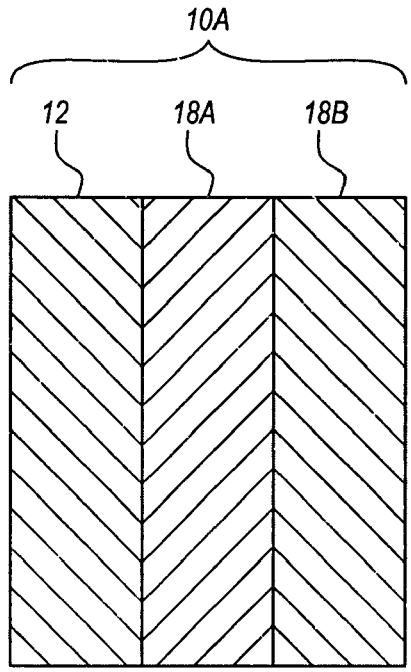
FIG. 2 is cross section side view of an alternative embodiment of an armor having a transformation layer and multiple absorption layers with dopants.

Depicted in FIG. 2 is an alternative embodiment of an armor plate 10A. Armor plate 10A comprises transformation layer 12, a first absorption layer 18A disposed on transformation layer 12 and a second absorption layer 18B disposed on first absorption layer 18A. Absorption layers 18A and 18B can have the same properties as discussed above with regard to absorption layer 18 and are coupled together so that lattice waves from transformation layer 12 can propagate thereto. However, absorption layers 18A and 18B can be formed with different dopants and/or concentrations thereof. For example, absorption layer 18A can be doped with heavy dopants while absorption layer 18B is doped with light dopants. Alternatively, absorption layers 18A and 18B can be formed with different combinations of heavy and light dopants. Likewise, absorption layer 18A can be doped with a high concentration of heavy dopants to optimize absorption of high frequency lattice waves while absorption layer 18B has a lower concentration of heavy dopants to optimize the refraction of lower frequency lattice waves. Absorption layers 18A and 18B can also be made of different base materials. In still other embodiments, alternative armor plates can be formed having three or more different absorption layers and two or more different transformation layers 12 each with different properties. It is appreciated that the absorption layer is typically more brittle that the transformation layer. In part, this is because adding dopants to a material can make the material more brittle. As such, separate absorption and transformation layers are typically used to help optimize the formation and absorption of the lattice waves.

Figure 3:
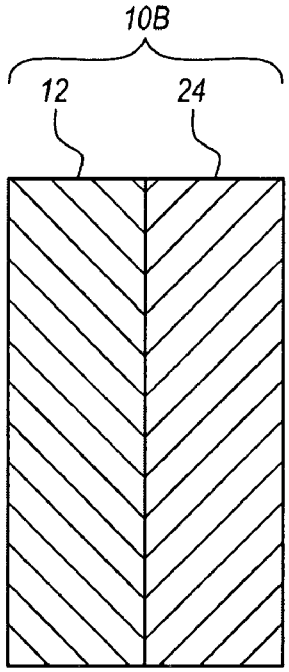
FIG. 3 is a cross sectional side view of an armor plate incorporating features of the present invention and having a transformation layer secured to an absorption layer, the absorption layer being comprised of a layered material.

Another method of lattice wave absorption utilizes layered materials. As used herein "layered materials" include materials that have a crystalline lattice comprised of a plurality of layers, each layer having a thickness of less than 100 μm and more commonly less than 1 μm. Such materials can naturally form in layers or can be fabricated, such as by deposition, into the multiple layers. For example, depicted in FIG. 3 is another alternative embodiment of an armor plate 10B incorporating features of the present invention. Armor plate 10B comprises transformation layers 12 as discussed above and an absorption layer 24. Absorption layer 24 is comprised of a layered material. The crystalline lattice of layered materials typically have a strong chemical bond within the plane and a weaker bond normal to the plane. Pyrolytic graphite is an example of such a material. Other layered materials include Se, SnS, mica, other layered silicates, max phase materials and the like.

The advantage of layered materials is that for any wavelength of lattice wave, it is generally possible to find a reflecting surface within the crystalline lattice. Repeated reflection of the lattice waves within the layered materials cause the lattice waves to travel increased distances within the layered materials. In turn, attenuation of the lattice waves increases as the distance the lattice waves travel within the layered material increases. That is, the layered materials absorb the energy of the lattice waves as the lattice waves reflect and travel within the layered materials.

Lattice wave reflection also has the additional benefit of creating a compressed region in the transformation layer 12 and/or the absorption layer 24 in front of the projectile as it travels within the armor plate. This compressed region has increased strength relative to the remainder of the armor plate and thus is better able to stop the projectile.

To improve the absorption capability of the naturally layered materials, the naturally layered materials can be doped using the same principals and dopants as discussed above with regard to absorption layer 18. That is, absorption layer 24 can be doped with dopants of different mass or isotopes thereof for absorbing lattice waves of different frequency and converting them to thermal energy. Absorption layer 24 can be attached to transformation layer 12 using the same techniques as discussed above with regard to absorption layer 18. Furthermore, absorption layer 24 can have the same thicknesses and configurations as discussed above with regard to absorption layer 24. However, naturally layered materials have lower mechanical strength relative to the base material metals and ceramics of absorption layer 18. As such, transformation layer 12 may be thicker in armor plate 10B than in armor plate 10.

Figure 4:
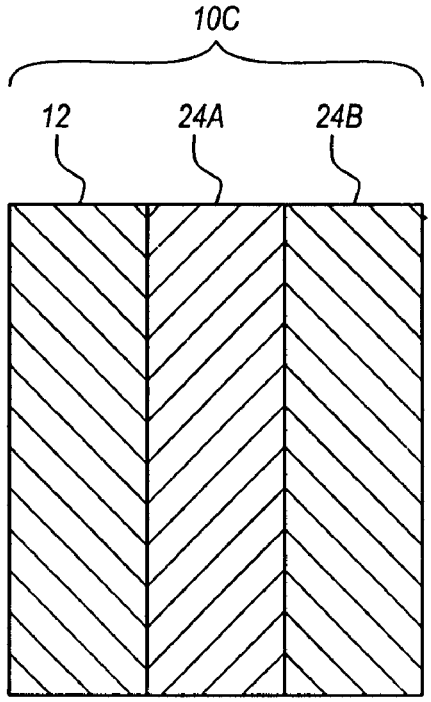
FIG. 4 is cross section side view of an alternative embodiment of an armor having a transformation layer and multiple absorption layers comprised of layered materials.

Depicted in FIG. 4 is another alternative embodiment of an armor plate 10C. Armor plate 10C comprises transformation layer 12, a first absorption layer 24A disposed on transformation layer 12 and a second absorption layer 24B disposed on first absorption layer 24A. Absorption layers 24A and 24B can have the same properties as discussed above with regard to absorption layer 24 and are coupled together so that lattice waves from transformation layer 12 can propagate thereto. However, to improve absorption properties, absorption layers 24A and 24B can be formed from different naturally layered materials, and/or with different dopants and/or different dopant percentages. In other embodiments, it is appreciated that armor plates can be formed with three or more layers of absorption layers 24.

Figure 5:
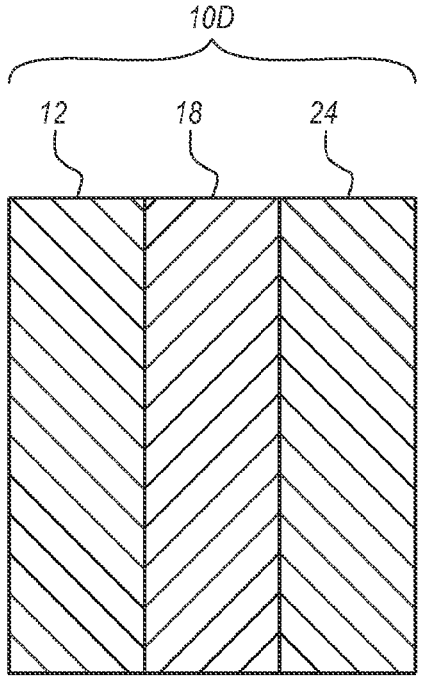
FIG. 5 is a cross sectional side view of an armor plate having a transformation layer and two or more absorption layers having dopants and/or being comprised of a layered material.

Depicted in FIG. 5 is another alternative embodiment of an armor plate 10D. Armor plate 10D comprises transformation layer 12, an absorption layer 18 disposed on transformation layer 12 and absorption layer 24 disposed on absorption layer 18. Absorption layers 18 and 24 have the properties as discussed above and are coupled together so that lattice waves formed within transformation layer 12 can propagate thereto. Using the different absorption layers, however, can improve the absorption of lattice waves over a broader frequency. In still other embodiments, it is appreciated that armor plates can be formed with combinations of multiple absorption layers 18 and/or multiple absorption layers 24 wherein each of the different layers can be formed with different base materials, different naturally layered materials, different dopants and/or different dopant percentages.

Figure 6:
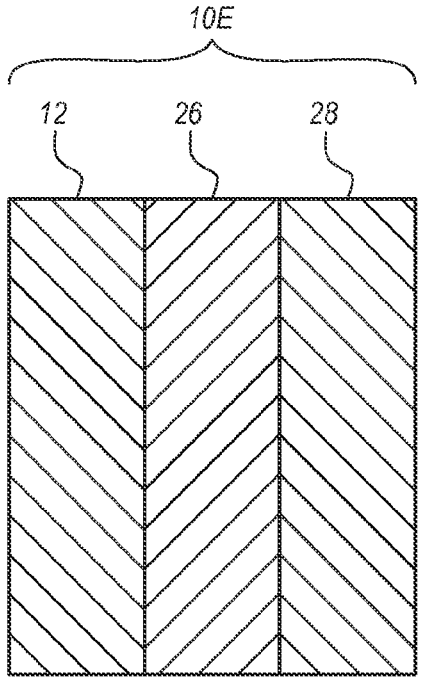
FIG. 6 is a cross sectional side view of an armor plate having a transformation layer, an absorption layer, and a spreading layer.

Depicted in FIG. 6 is another embodiment of an armor plate 10E incorporating features of the present invention. Armor plate 10E comprises transformation layer 12, an absorption layer 26 disposed on transformation layer 12 and a spreading layer 28 disposed on absorption layer 26. Absorption layer 26 can comprise absorption layer 18, absorption layer 24 or any combination of any of the absorption layers as discussed above. Spreading layer 28 is comprised of material with low lattice wave attenuation and is designed to spread the lattice waves laterally so that the force thereof can be dispersed over a larger surface area. That is, the lateral transfer of the lattice waves reduces the transfer of the localized impact momentum of the projectile by laterally dispersing a portion of the localized impact momentum. Thus, spreading layer 28 can reduce blunt trauma to the person or structure on which armor plate 10E is being used. In one embodiment, spreading layer is comprised of a material capable of propagating sound at a speed of at least 6 km/s.

In one embodiment, spreading layer 28 is comprised of a crystalline material such as sapphire, quartz, spinets, or the like. Such crystal materials, however, can be expensive. Alternatively, spreading layer 28 can be comprised of fibers having a high strength and a high sound speed which can approximate a layer of a single crystal material. For example high molecular weight polyethylene fibers an other polymeric fibers can be used. Such fibers are typically embedded within a matrix material, such as an epoxy or other resin, and formed into a sheet or layer. Where armor plate 10E is being used in a SAPI or other form of body armor, it is appreciated that the fibers are typically oriented in a linear pattern so as to optimize lateral dispersion. In one embodiment, the fibers can be oriented so as to completely extend around the wearer of the body armor. For example, if the body armor comprises a vest or jacket, at least a portion of the fibers can be oriented to horizontally encircle the torso of the wearer and/or can linearly extend from the waist at the front, over a shoulder, and then down to the waist at the back of the wearer. Other orientations can also be used. It is appreciated that the fibers can be woven to improve their strength properties. Furthermore, different combinations of fibers can be used and different layers of different fibers can be used. It is also appreciated that sheets of polymeric materials having a high sound speed, such as sheets of high molecular weight polyethylene, can also be used.

In addition to crystals, fibers, and polymeric sheets, spreading layer 28 can be comprised of metals or semi-metals having a high sound speed. For example, spreading layer 28 can be comprised of boron, magnesium, aluminum, compounds thereof or the like. Spreading layer 28 can have the same thicknesses and configurations as discussed above with regard to the absorptions layers.

As discussed above, the various functional layers of the armor plates can be used independently or in a variety of different combinations depending on desired functional properties and weight considerations. The safest armor plate would likely have a combination of a transformation layer, absorption layer and spreading layer. The total thickness for the above discussed armor plates, which can be a minimum or maximum and which can include other layers that may be secured thereto, is typically in a range between about 2 mm to about 40 mm with about 2 mm to about 20 mm, about 2 mm to about 15 mm, about 2 mm to about 10 mm and about 2 mm to about 6 mm being common. Larger thicknesses such as in a range between about 1 cm to about 8 cm or larger can also be used in other applications. Such larger thicknesses, however, are less common in body armor due to the associated weight. The exterior face of the armor plates need not be smooth or planar but can be contoured in any desired configuration. Furthermore, the armor plates need not have a uniform thickness but can vary based on intended use.

Figure 7:
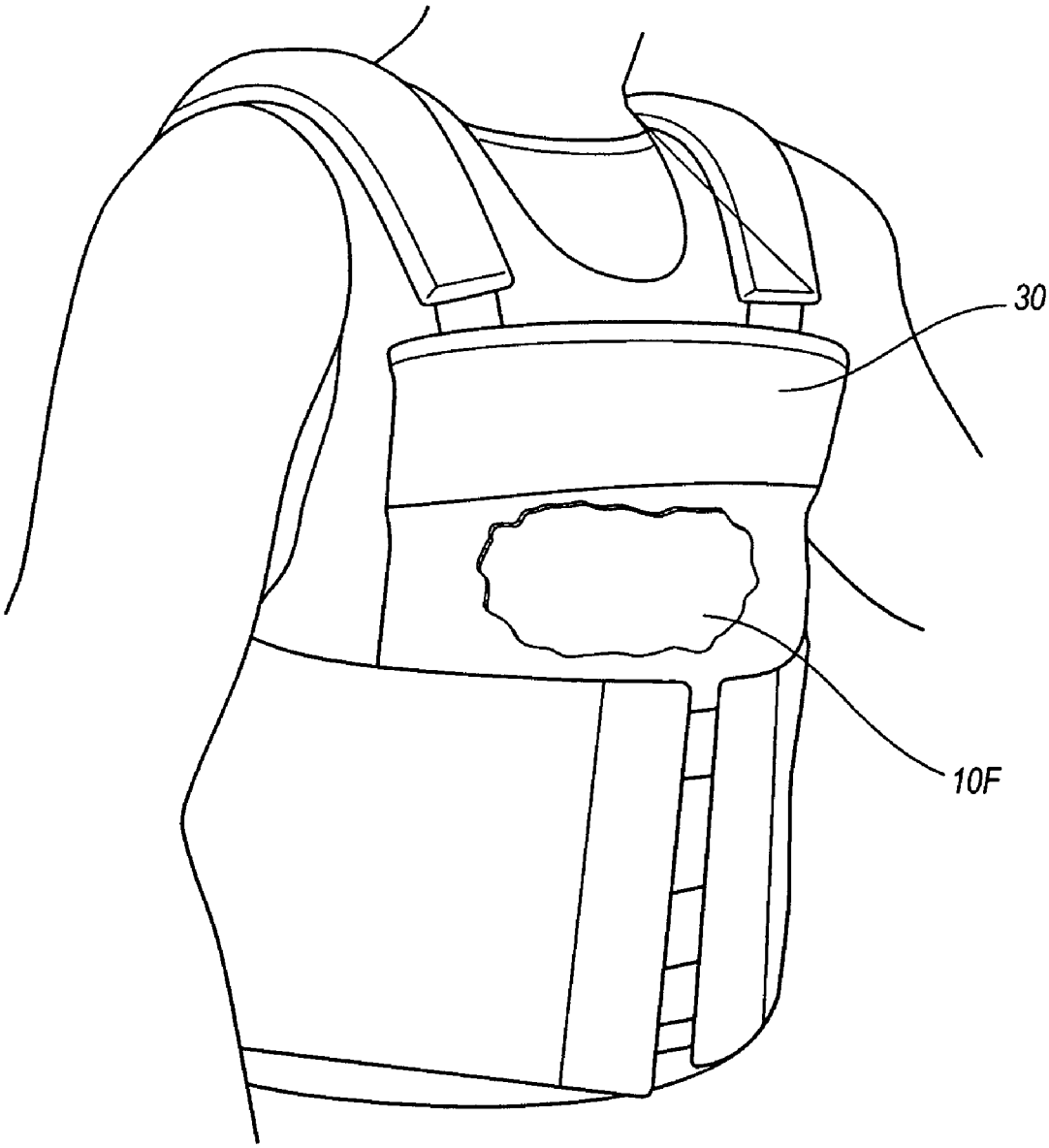
FIG. 7 is a perspective view of a body armor vest incorporating an inventive body armor plate.
Figure 8:
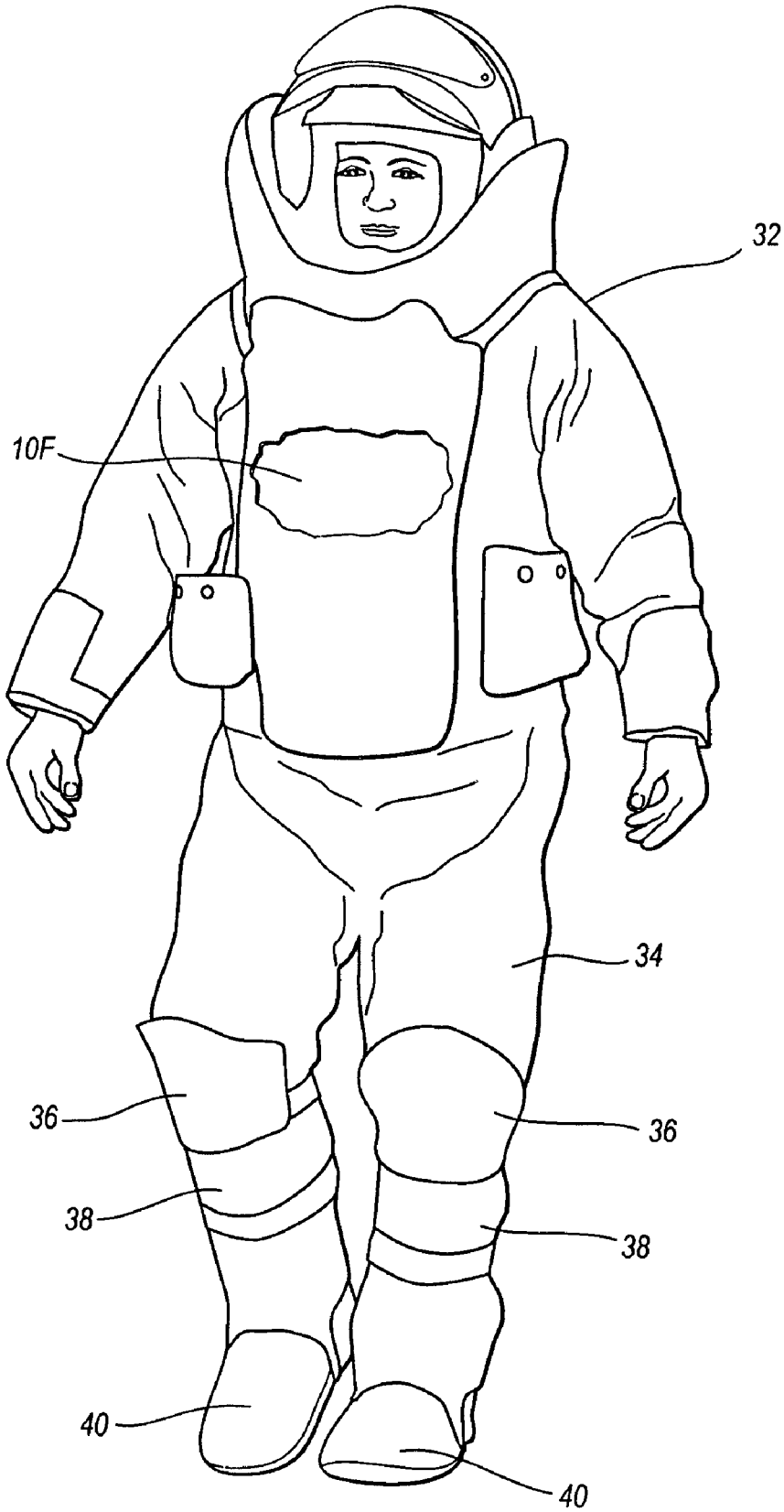
FIG. 8 is a perspective view of a body armor suite incorporating inventive body armor plates.
Figure 9:
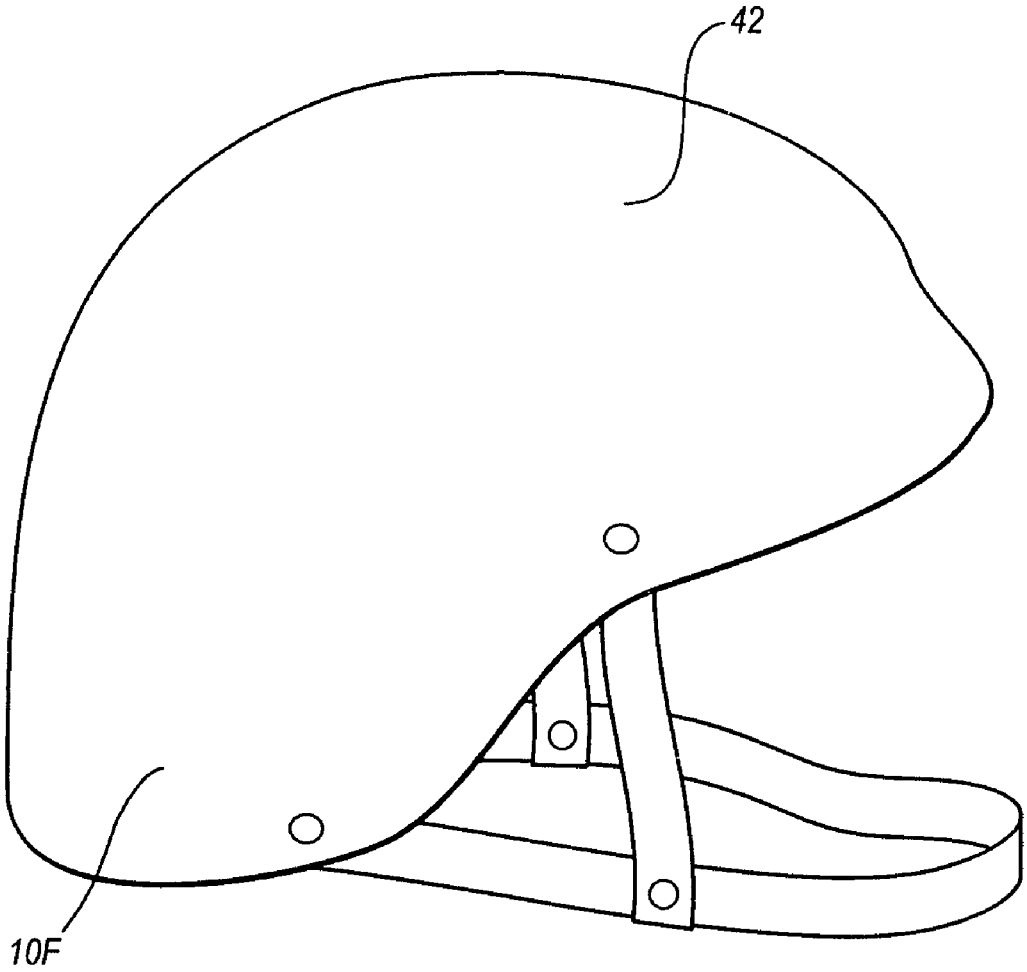
FIG. 9 is a perspective view of a helmet comprised of an inventive body armor plate.

As previously discussed, the armor plates can be used a variety of different applications. By way of example, the armor plates can be used as part of body armor. The term "body armor" as used herein is broadly intended to include any armor that is configured to be worn on or carried by an individual. By way of example and not by limitation, body armor can comprise a vest, jacket, helmet, pants, boots, gloves, knee guards, shin guards, undergarment or the like. Body armor can also comprise plates, shields, packs, or other structures that are configured to be carried or attached to an individual. The body armor can be for military use, police use, bomb disposal, personal protection or other applications where protective armor is desired. Specific illustrated examples of body armor include the vest 30 as shown in FIG. 7 and the jacket 32, pants 34, knee guards 36, shin guards 38, and boots 40 as shown in FIG. 8. FIG. 9 shows a helmet 42 that can be used as part of the present invention. The various illustrated pieces of body armor can also have a variety of other conventional configurations.

In one embodiment it is appreciated that the body armor can simply comprise one or more of the armor plates as discussed above shaped into a desired configuration, such as helmet 42, wherein straps, buckles, fasteners, or other attached structure are coupled to the armor plate(s) for securing the body armor to an individual. To that end, it is appreciated that that an armor plate need not be a planar plate but can be contoured into any desired configuration.

Figure 10:
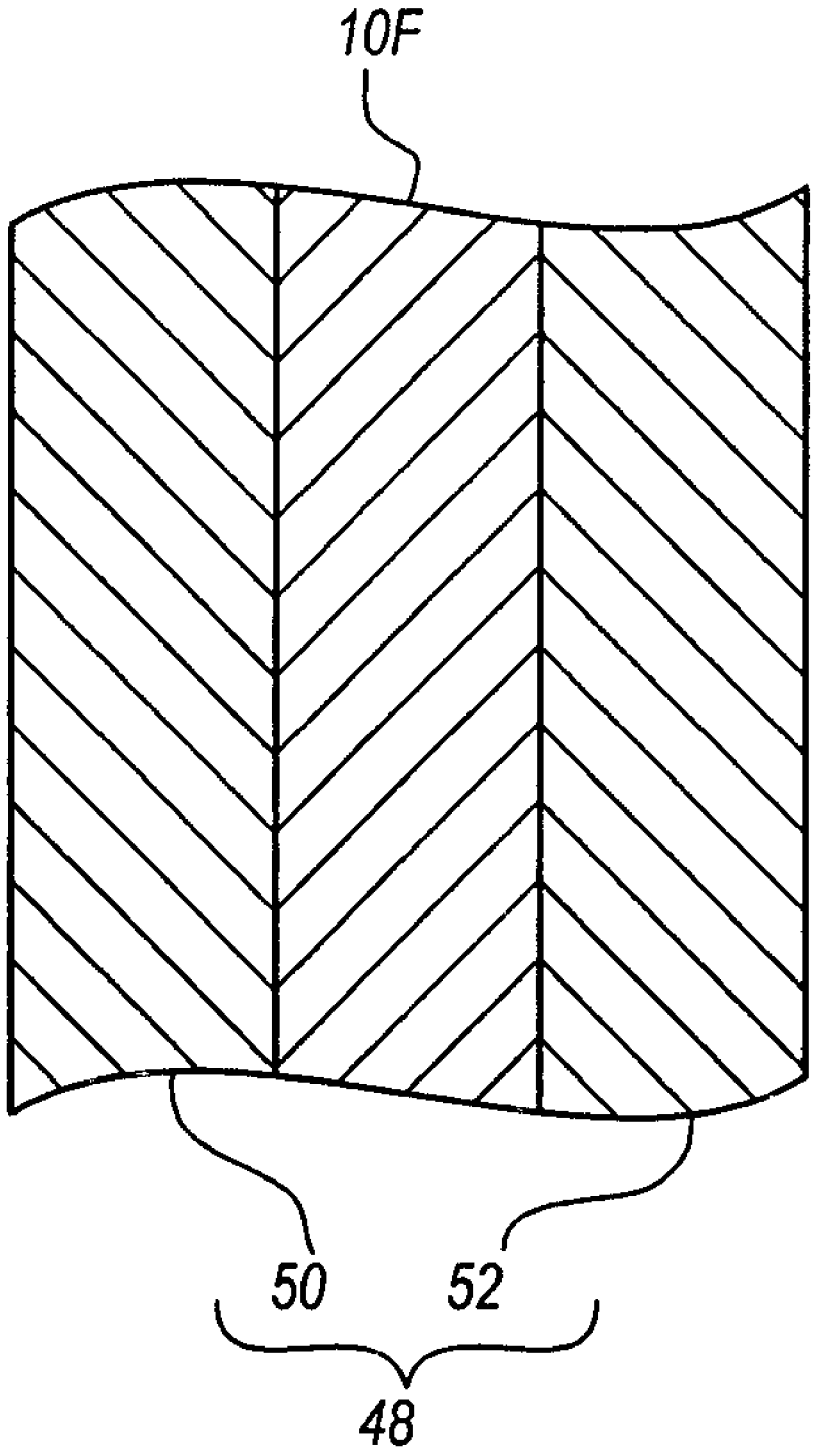
FIG. 10 is a cross sectional side view of body armor showing an inventive body armor plate disposed within an outer shell.

In other alternative embodiments, the body armor can comprise an outer shell to which an armor plate is inserted, attached or otherwise secured. By way of example and not by limitation, depicted in FIG. 10 is a cross sectional side view of a section of a body armor such as a vest, jacket pants, or the like. As shown therein, the body armor comprises an outer shell 48 comprised of an outer layer 50 and an inner layer 52. The body armor also comprises an armor plate 10F positioned between layers 50 and 52. Outer layer 50 and inner layer 52 are typically comprised of a flexible woven fabric. The woven fabric for layers 50 and 52 is typically comprised of high strength fibers that are woven together so that outer shell forms a soft armor. For examples, the fibers can be comprised of aramide (Kevlar®), high molecular weight polyethylene (Dyneema®, Spectra®), ballistic nylon, carbon fibers or other high strength fibers commonly used in soft armor.

It is appreciated that each of layers 50 and 52 can be comprised of a single layer or a plurality of layers of woven fabric and that the layers can be freely disposed adjacent to each other or secured together such as by stitching or an adhesive in any conventional method. It is common that the layers of woven fabric are coated with or impregnated with an epoxy or other resin which is used to bond the layers and/or fibers together and which can be used to secure the layers directly to the armor plates discussed herein. Furthermore, each of layers 50 and 52 can be comprised of a variety of different fibers woven together and/or the different sublayers within each layer 50 and 52 can be comprised of different materials. Layers 50 and 52 can also be comprised of other flexible materials such as flexible polymeric sheets. In general, it is appreciated that layers 50 and 52 can be comprised of any flexible material that can be used for soft armor. The soft armor can typically be used for stopping bullets and small fragments with a velocity up to 500-600 m/s.

Layers 50 and 52 also function for housing and securing armor plate 10F. Armor plate 10F can comprise any of the armor plates as discussed above, such as armor plates 10, 10A-10E, or any modified armor plates as discussed above. The body .armor can comprise one continuous armor plate 10F that is disposed between layers 50 and 52. In an alternative embodiment, the body armor can comprises a plurality of discrete armor plates 10F that are either removably positioned within or secured between layers 50 and 52. The plurality of armor plates 10F can also be positioned side-by-side or overlapping. In one embodiment layers 50 and 52 can form one or more separate pockets wherein a separate armor plate is positioned within each pocket. Armor plate 10F can thus be movably positioned adjacent to layers 50 and 52. Alternatively, armor plate 10F can be secured to one or both of layers 50 and 52 such as by an adhesive. In some embodiments, it is appreciated that layer 50 and/or 52 can be considered as a part of armor plate 10F. In still other embodiments, it is appreciated that only one of layers 50 or 52 can be used.

In other embodiments, it is appreciated that one or more armor plates 10F can be mounted on a structure such as a building, bunker, or any other structure or item where it is desired to reduce the impact from a projectile. One or more armor plates 10F can also be mounted on a vehicle such as the bottom or side surface of a jeep, truck, car or the like or on the interior or exterior surface of an airplane and on different forms of shields such as on turrets placed on armored vehicles or about military weapons.

By using the inventive armor plates in body armor, the improved efficiency in the attenuation of energy applied from an impacting projectile enables that armor plates to be made lighter while still providing the same protection. By lightening the weight of the armor plates, the user of the body armor has greater agility and stamina relative to those wearing the heavier body armor. Alternatively, the inventive armor plates can be made to have the same weight as conventional armor plates. However, the unique properties of the armor plate would provide added protection to the user of the body armor relative to those in conventional body armor. Other benefits for the inventive armor plates and body armor are set forth above or would be inherent to one skilled in the art based on the teachings herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An armor plate comprising:

a transformation layer comprised of a material having a tensile strength in a range between about 50 MPa to about 500 MPa and a deformation before failure of at least 20%, the transformation layer producing lattice waves when struck by a projectile; and an absorption layer disposed adjacent to the transformation layer such that when the transformation layer is struck by a projectile, the lattice waves generated within the transformation layer propagate into the absorption layer, the absorption layer being comprised of a base material having a first dopant dispersed therein, the base material being comprised of a metal or a ceramic, wherein the first dopant creates phonon absorption centers in the absorption layer that absorb the lattice waves.

2. The armor plate as recited in claim 1, wherein the combined transformation layer and absorption layer having a maximum thickness in a range between about 2 mm and about 15 mm.

3. The armor plate as recited in claim 1, wherein the absorption layer is directly secured to the transformation layer.

4. The armor plate as recited in claim 1, wherein the material for the transformation layer is comprised of titanium, steel, aluminum or an alloy thereof.

5. The armor plate as recited in claim 1, wherein the material for the transformation layer is comprised of polycarbonate or a high molecular weight polyethylene.

6. The armor plate as recited in claim 1, wherein the transformation layer is free of any dopants.

7. The armor plate as recited in claim 1, wherein the absorption layer is comprised of a ceramic selected from the group consisting of $Al_2O_3$, $B_4C$, $TiB_2$, SiC, $ZrO_2$ silicates, or cordierites.

8. The armor plate as recited in claim 1, wherein the absorption layer is comprised of titanium, steel, aluminum or an alloy thereof.

9. The armor plate as recited in claim 1, wherein the first dopant comprises Zr, Mo, Dy, Yb, W, Ta, Th, U or $TiZrO_4$.

10. The armor plate as recited in claim 1, wherein the first dopant comprises Ti, Cr, Mn, Fe, or Co.

11. The armor plate as recited in claim 1, wherein the absorption layer is more brittle than the transformation layer.

12. The armor plate as recited in claim 1, wherein the absorption layer is secured to the transformation layer by an adhesive.

13. The armor plate as recited in claim 1, further comprising an outer layer comprised of a fabric woven from fibers.

14. The armor plate as recited in claim 13, wherein the fibers comprise aramide fibers or high molecular weight polyethylene fibers.

15. The armor plate as recited in claim 1, further comprising a spreading layer secured to the absorption layer, the spreading layer being comprised of a material capable of propagating sound at a speed of at least 6 km/s.

16. The armor plate as recited in claim 15, wherein the spreading layer is comprised of high molecular weight polyethylene, sapphire, quartz, spinels, boron, Mg, or Al.

17. The armor plate as recited in claim 1, wherein the transformation layer is free of dopants and the absorption layer is disposed directly adjacent to the transformation layer.

18. A body armor comprising:

an outer shell comprised of a fabric woven from fibers; and an armor plate as recited in claim 1 secured to the outer shell.

19. The body armor as recited in claim 18, wherein the outer shell is in the form of a vest, jacket or pants.

20. The body armor as recited in claim 18, wherein the fibers comprise aramide fibers or high molecular weight polyethylene fibers.

21. The body armor as recited in claim 18, further comprising:

wherein the transformation layer is comprised of titanium, steel, or an alloy thereof;

wherein the base material for the absorption layer is comprised of a ceramic selected from the group consisting of $Al_2O_3$, $B_4C$, $TiB_2$, SiC, $ZrO_2$ silicates, or cordierites; and wherein the first dopant comprises Zr, Mo, Dy, Yb, W, Ta, Th, U or $TiZrO_4$.

22. An armor plate comprising:

a transformation layer comprised of a material having a tensile strength in a range between about 50 MPa to about 500 MPa and a deformation before failure of at least 20%; and an absorption layer comprising a first dopant dispersed in the absorption layer, the absorption layer disposed adjacent to the transformation layer such that when the transformation layer is struck by a projectile, lattice waves generated within the transformation layer can propagate into the absorption layer, the absorption layer being comprised of a plurality of sublayers having a maximum thickness of less than 100 μm.

23. The armor plate as recited in claim 22, wherein the combined transformation layer and absorption layer having a maximum thickness in a range between about 2 mm and about 15 mm.

24. The armor plate as recited in claim 22, wherein the absorption layer is comprised of pyrolytic graphite, tin sulfide, selenium, mica, a max phase material or a layered silicate.

25. The armor plate as recited in claim 22, wherein the first dopant comprises Zr, Mo, Dy, Yb, W, Ta, Th, U or $TiZrO_4$.

26. The armor plate as recited in claim 22, wherein the first dopant comprises Ti, Cr, Mn, Fe, or Co.

27. The armor plate as recited in claim 22, wherein the absorption layer is more brittle than the transformation layer.

28. The armor plate as recited in claim 22, wherein the absorption layer is secured to the transformation layer by an adhesive.

29. The armor plate as recited in claim 22, wherein the material for the transformation layer is comprised of titanium, steel, aluminum or an alloy thereof.

30. The armor plate as recited in claim 22, wherein the material for the transformation layer is comprised of polycarbonate or a high molecular weight polyethylene.

31. The armor plate as recited in claim 22, further comprising an outer layer comprised of a fabric woven from fibers.

32. The armor plate as recited in claim 22, further comprising a spreading layer secured to the absorption layer, the spreading layer being comprised of a material capable of propagating sound at a speed of at least 6 km/s.

33. The armor plate as recited in claim 32, wherein the spreading layer is comprised of high molecular weight polyethylene, sapphire, quartz, spinels, Mg, or Al.

34. An armor plate comprising:

a transformation layer comprised of a material having a tensile strength in a range between about 50 MPa to about 500 MPa and a deformation before failure of at least 20%, the transformation layer producing lattice waves when struck by a projectile; and an absorption layer disposed adjacent to the transformation layer such that when the transformation layer is struck by a projectile, lattice waves generated within the transformation layer propagate into the absorption layer, the absorption layer being comprised of a base material having a first dopant dispersed therein, the base material being comprised of a metal or a ceramic and the dopant included in a concentration that breaks lattice symmetry, wherein the dopant causes absorption of lattice waves propagated from the transformation layer.

35. The armor plate as recited in claim 34, wherein the first dopant has a concentration in a range from 0.5 to 20 atomic percent and the first dopant includes Zr, Mo, W, Ta, Th, U, or $TiZrO_4$.

* * * * *